US010906303B2

(12) United States Patent
Osanai

(10) Patent No.: US 10,906,303 B2
(45) Date of Patent: Feb. 2, 2021

(54) LIQUID DISCHARGING APPARATUS, LIQUID DISCHARGING HEAD, AND METHOD FOR DRIVING LIQUID DISCHARGING HEAD

(71) Applicant: Shinichiroh Osanai, Kanagawa (JP)

(72) Inventor: Shinichiroh Osanai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/575,905

(22) Filed: Sep. 19, 2019

(65) Prior Publication Data

US 2020/0101727 A1 Apr. 2, 2020

(30) Foreign Application Priority Data

Sep. 28, 2018 (JP) ..... 2018-186007
Aug. 13, 2019 (JP) ..... 2019-148393

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC . B41J 2/04588; B41J 2/04581; B41J 2/04591
See application file for complete search history.

(56) References Cited

U.S. PATENT DOCUMENTS

| | | | |
|---|---|---|---|
| 8,931,871 | B2 | 1/2015 | Iwama |
| 9,289,980 | B2 | 3/2016 | Mori |
| 10,207,495 | B2 | 2/2019 | Aoyagi et al. |
| 2012/0236053 | A1* | 9/2012 | Tamura ..... B41J 2/04588 |

FOREIGN PATENT DOCUMENTS

| | | |
|---|---|---|
| JP | 2013-063622 | 4/2013 |
| JP | 2017-164973 | 9/2017 |
| JP | 6252488 | 12/2017 |
| JP | 2018-083405 | 5/2018 |

* cited by examiner

*Primary Examiner* — Juanita D Jackson
(74) *Attorney, Agent, or Firm* — IPUSA, PLLC

(57) ABSTRACT

A liquid discharging apparatus includes a liquid discharging head that discharges liquid from a nozzle, and a driving signal substrate that inputs, to the liquid discharging head, a driving signal according to waveform data. The liquid discharging head includes a driving element that drives the nozzle, switching elements connected to the driving element, a signal transmitter connected to the driving element via the switching elements and including signal lines through which the driving signal is transmitted according to waveform data, and a potential difference detector that detects a potential difference based on an intermediate potential of the driving signal transmitted through each signal line. The liquid discharging apparatus generates a correction signal based on the potential difference; corrects the waveform data based on the correction signal; generates the driving signal based on the corrected waveform data; and outputs the generated driving signal to the corresponding signal line.

11 Claims, 13 Drawing Sheets

LIQUID DISCHARGING APPARATUS, LIQUID DISCHARGING HEAD, AND METHOD FOR DRIVING LIQUID DISCHARGING HEAD

CROSS-REFERENCE TO RELATED APPLICATION

The present application is based on and claims priority under 35 U.S.C. § 119 to Japanese Patent Application No. 2018-186007, filed on Sep. 28, 2018, and Japanese Patent Application No. 2019-148393, filed on Aug. 13, 2019, the contents of which are incorporated herein by reference in their entirety.

BACKGROUND OF THE INVENTION

1. Field of the Invention

The present invention relates to a liquid discharging apparatus, a liquid discharging head, and a method for driving the liquid discharging head.

2. Description of the Related Art

As a liquid discharging apparatus including a liquid discharging head, a so-called piezo-type apparatus is known, in which a vibration plate, which forms a wall surface of a liquid flow path, is deformed by using a driving element such as a piezoelectric element, thereby changing the internal volume of the liquid flow path and discharging the liquid.

This type of liquid discharging apparatus electrically controls the liquid (liquid droplets) to be discharged, and is therefore capable of controlling the liquid droplet size and the like in a fine manner. Thus, this type of liquid discharging apparatus is advantageous when used in a recording apparatus that forms high-definition images with microscopic liquid droplets, such as an inkjet printer.

The liquid discharging apparatus includes a driving signal generation circuit for generating driving signals to be applied to the driving element provided in the liquid discharging head. It is known that it is possible to record, in the driving signal generation circuit, waveform data according to the liquid droplet size, the ink temperature, etc., and to enable selection of the waveform data (see, for example, Patent Document 1).

Patent Document 1: Japanese Unexamined Patent Application Publication No. 2018-83405

SUMMARY OF THE INVENTION

According to one aspect of the present invention, there is provided a liquid discharging apparatus including a liquid discharging head configured to discharge liquid from a nozzle; a driving signal substrate configured to input, to the liquid discharging head, a driving signal according to waveform data; a driving element configured to drive the nozzle; a plurality of switching elements connected in parallel to the driving element; a first signal transmitter connected to the driving element via the plurality of switching elements and formed of a plurality of signal lines through which the driving signal is transmitted; a switching controller configured to perform switching control to selectively turn on one of the plurality of switching elements; a potential difference detector configured to detect a potential difference based on an intermediate potential of the driving signal transmitted through each of the plurality of signal lines; a correction signal generator configured to generate a correction signal based on the potential difference; a correction processor configured to correct the waveform data based on the correction signal; and a driving signal generator provided to each of the plurality of signal lines and configured to generate the driving signal based on the waveform data corrected by the correction processor and to output the generated driving signal to a corresponding signal line among the plurality of signal lines.

DETAILED DESCRIPTION OF THE PREFERRED EMBODIMENTS

Figure 1:
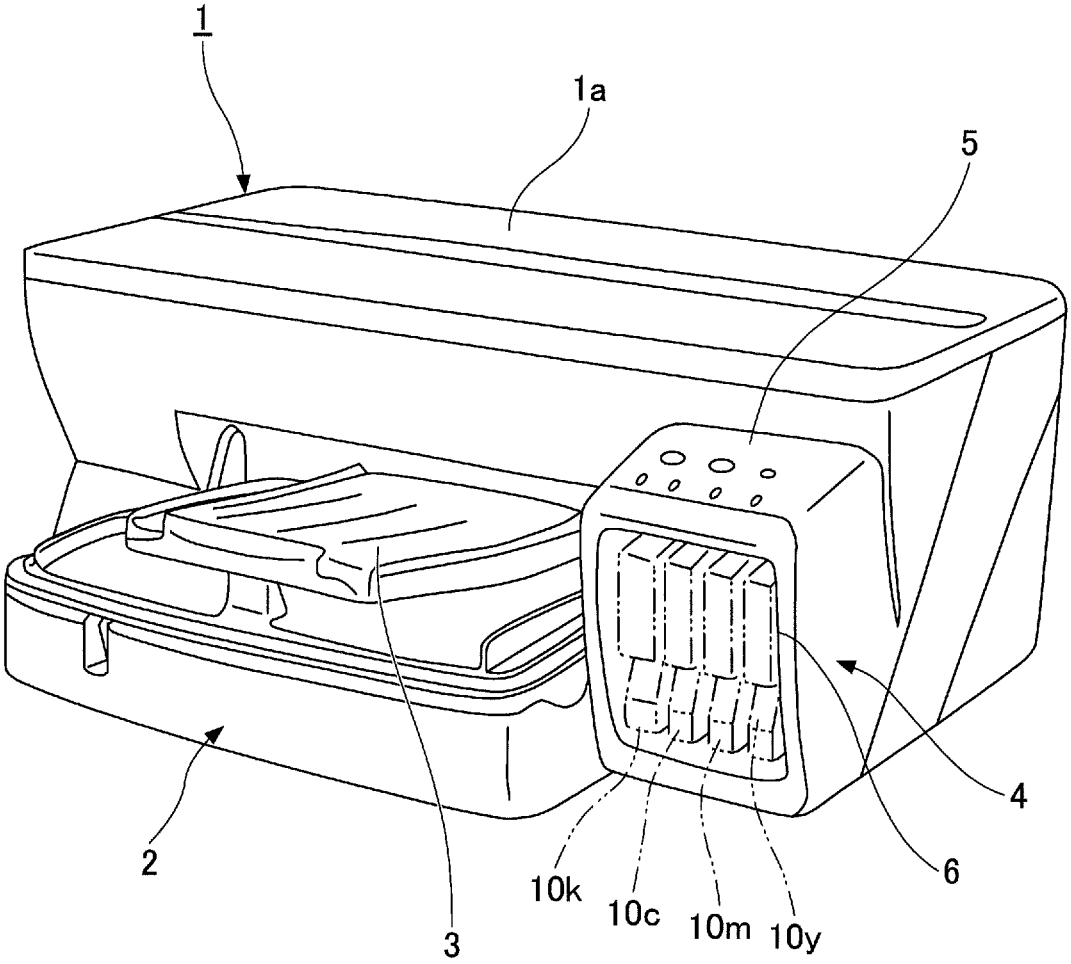
FIG. 1 is an external perspective view of a liquid discharging apparatus viewed from a front side according to a first embodiment of the present invention.

It is conceivable to provide a plurality of driving signal generating circuits with respect to a single driving element, and by switching the driving signal generating circuit with a switch, the driving signal input to the driving element can be switched. According to this configuration, the driving signal can be switched at high speed depending on the liquid droplet size and the like.

However, there are cases where the intermediate potential (reference potential) of the plurality of driving signals input to a single driving element differs depending on manufacturing variations or the like in the driving signal generation circuits or transmission paths. In such cases, the potential will change instantaneously at the time of switching the driving signal, and an unexpected current will be input to the driving element, causing malfunctions or failures of the driving element.

A problem to be addressed by an embodiment of the present invention is to prevent the potential from changing when switching the driving signal.

Hereinafter, an embodiment for carrying out the present invention with reference to the drawings will be described. In the drawings, the same elements are indicated by the same reference numerals and overlapping descriptions may be omitted. In the embodiments described below, as an example of a liquid discharging apparatus to which an embodiment of the present invention is applied, an inkjet printer that discharges ink onto a recording medium to form an image, is exemplified.

First Embodiment

Hereinafter, a liquid discharging apparatus according to a first embodiment of the present invention will be described.

Configuration of Liquid Discharging Apparatus According to First Embodiment

FIG. 1 is a perspective view illustrating a liquid discharging apparatus 1 according to the present embodiment viewed from the front side.

The liquid discharging apparatus 1 includes an apparatus main body 1*a*, a paper feeding tray 2, and a paper ejecting tray 3. The paper feeding tray 2 is detachably mounted to the apparatus main body 1*a* and feeds a paper sheet 11 (see FIG. 2), as a recording medium, to the apparatus main body 1*a*. The paper ejecting tray 3 is detachably mounted to the apparatus main body 1*a*, and stocks the paper sheets 11 on which images are recorded (formed) by the apparatus main body 1*a*.

At one end of the front surface of the apparatus main body 1*a*, a cartridge loading unit 4 for loading ink cartridges is provided. On the upper surface of the cartridge loading unit 4, an operation display unit 5 including operation buttons and a display is provided.

The cartridge loading unit 4 is configured to insert and load a plurality of ink cartridges 10*k*, 10*c*, 10*m*, and 10*y* of different ink colors, from the front side to the rear side of the apparatus main body 1*a*.

The ink cartridge 10*k* contains black (K) ink. The ink cartridge 10*c* contains cyan (C) ink. The ink cartridge 10*m* contains magenta (M) ink. The ink cartridge 10*y* contains yellow (Y) ink. When the color of the ink is not distinguished, these are simply referred to as the ink cartridge 10.

On the front side of the cartridge loading unit 4, a front cover 6, which is opened when the ink cartridge 10 is mounted or removed, is provided so to be capable of being opened or closed. The ink cartridges 10*k*, 10*c*, 10*m*, and 10*y* are loaded by being arranged along a horizontal direction, with each of the ink cartridges 10 being placed vertically.

On the operation display unit 5, a remaining amount display unit for displaying the remaining amount of ink in the ink cartridges 10*k*, 10*c*, 10*m*, and 10*y* of the respective colors, a power supply button, a paper feed/print resume button, and a cancel button, etc., are disposed.

Figure 2:
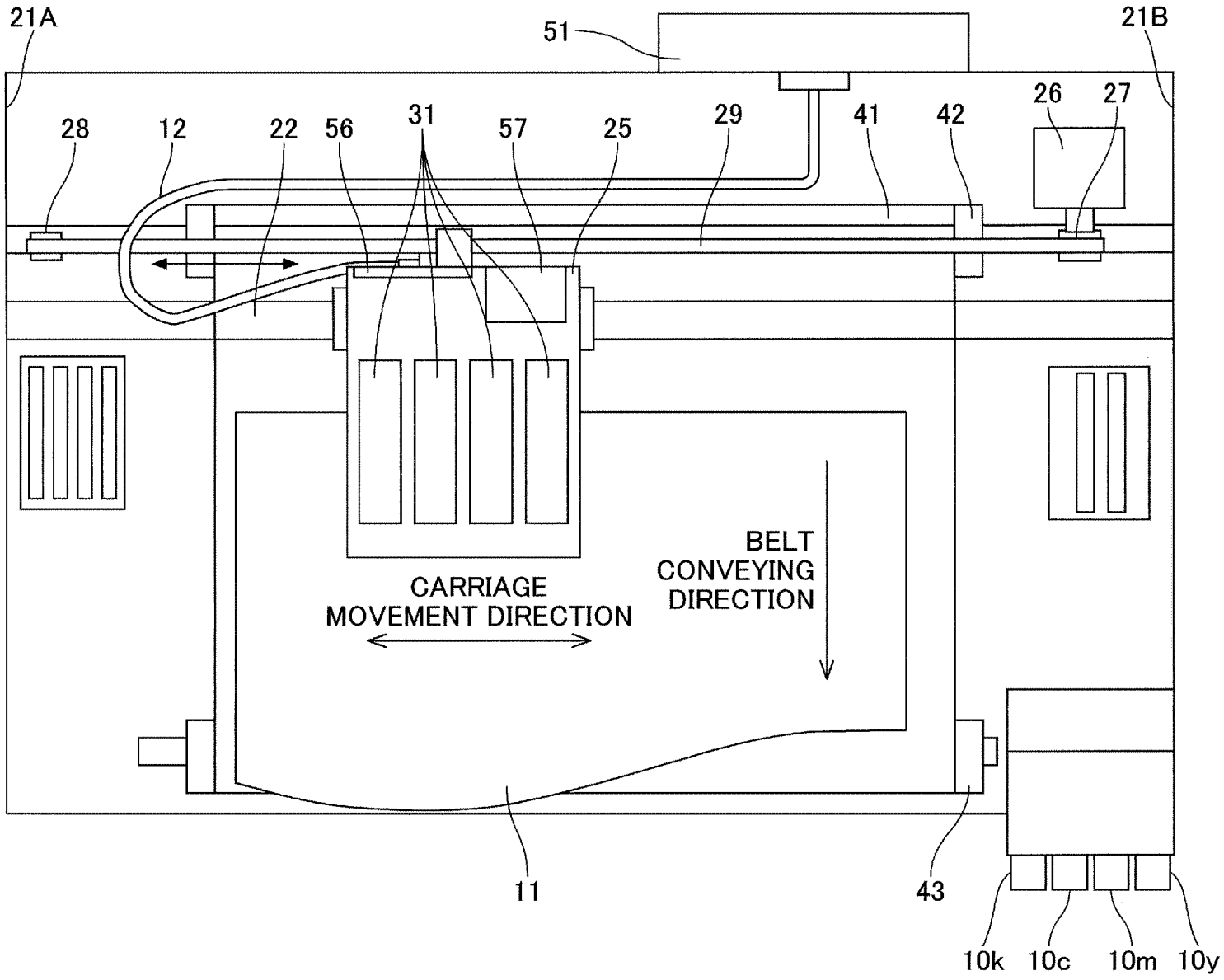
FIG. 2 is a plan view schematically illustrating a mechanism unit of the liquid discharging apparatus according to the first embodiment of the present invention.

Next, a mechanism unit of the liquid discharging apparatus 1 will be described with reference to FIG. 2. FIG. 2 is a schematic plan view of a mechanism unit of the liquid discharging apparatus 1.

A carriage 25 is slidably held in the main scanning direction (the longitudinal direction of a guide rod), by a guide rod 22, which is the main guide member, and a subordinate guide member (a guide rod, a guide stay, or the like). The guide rod 22 is laterally bridged between main side plates 21A and 21B forming a frame member of the apparatus main body 1*a*.

The carriage 25 is moved and scanned in the main scanning direction by a main scanning mechanism including a main scanning motor 26, a driving pulley 27, a driven pulley 28, and a timing belt 29.

The carriage 25 includes four liquid discharging heads 31, each of which being integrally formed with a sub-tank, that discharge ink droplets (liquid droplets) of the respective colors of black (K), cyan (C), magenta (M), and yellow (Y), for example.

In each of the liquid discharging heads 31, an array of nozzles including a plurality of nozzles 98*a* (see FIG. 3) is formed in the sub scanning direction perpendicular to the main scanning direction. The liquid discharging heads 31 are mounted to the carriage 25, with the liquid discharge direction facing downward.

In the carriage 25, driving signals from a driving signal substrate 51 are input to the liquid discharging head 31 via a flexible flat cable (FFC) 12 as a wiring member and a relay substrate 56. The relay substrate 56 is provided in the carriage 25.

On the other hand, below the carriage 25, a conveying belt 41 as a conveying means for conveying, in the sub scanning direction, the paper sheet 11, which is fed from the paper feeding tray 2, is disposed. The conveying belt 41 is an endless belt and is stretched across a conveying roller 42 and a tension roller 43. The conveying belt 41 is rotated in the belt conveying direction, as the conveying roller 42 is rotationally driven by a sub scanning motor 210 (see FIG. 4).

Structure of Liquid Discharging Head According to First Embodiment

Figure 3:
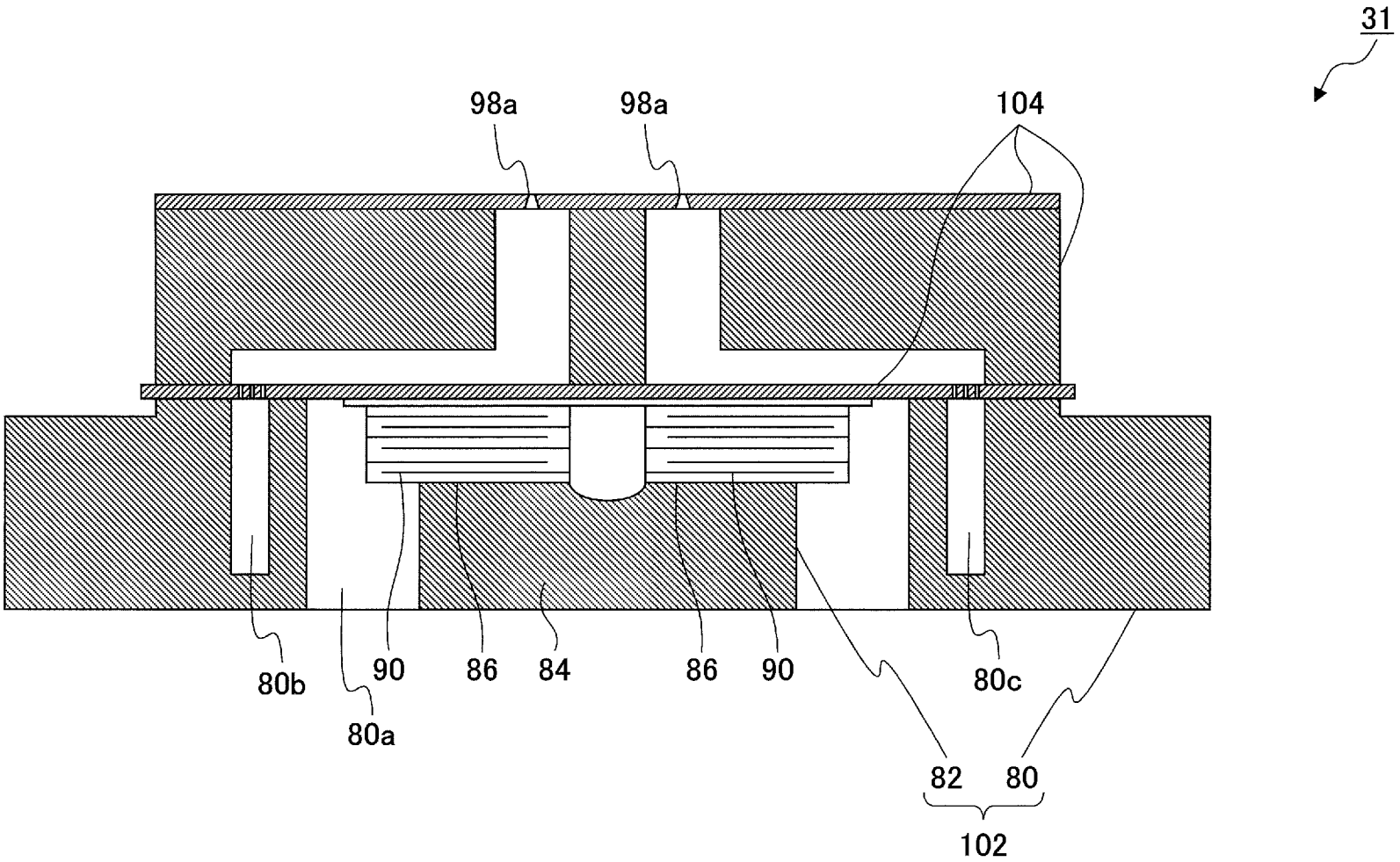
FIG. 3 is a cross-sectional view of a liquid discharging head according to the first embodiment of the present invention.

Next, the structure of the liquid discharging head 31 will be described. FIG. 3 is a cross-sectional view of the liquid discharging head 31.

The liquid discharging head 31 includes a driving unit 102 and a liquid chamber unit 104. The driving unit 102 is made of, for example, thermoplastic resin, and includes a frame member 80 having a hollow portion 80*a* formed in a center portion thereof as a housing space of a pressure generating device, and a pressure generating device 82 disposed in the hollow portion 80*a*.

A pair of common liquid chambers 80*b* and 80*c* is formed on both sides of the frame member 80 in a direction perpendicular to the longitudinal direction of the frame member 80, with the hollow portion 80*a* sandwiched between the common liquid chambers 80*b* and 80*c*.

The pressure generating device 82 includes a base member 84 shaped as a rectangular parallelepiped formed of ceramic or metal, or a hard material, for example, stainless steel; and a plurality of piezoelectric elements 86 arranged in a matrix of two rows and an n number of columns on the base member 84.

Each of the piezoelectric elements 86 is a stacked piezoelectric element. Multiple internal electrodes 90 are provided in each of the piezoelectric elements 86, and the internal electrodes 90 are alternately drawn out at both end faces at every other layer and are respectively connected to individual end-face electrodes made of, for example, an AgPd alloy or the like, formed at both end faces. The individual end-face electrode of each of the piezoelectric elements 86 on the end face facing the other piezoelectric element of the same row, is connected to a common electrode on the base member 84.

In each of the piezoelectric elements 86, a flexible printed circuit (FPC) is soldered to the individual end-face electrode on the end face not facing the other piezoelectric element on the same row and to the common electrode, and the common electrode is connected to the ground potential.

Each of the piezoelectric elements 86 generates an electric field in the stack direction when a driving signal is applied, and displaces in the stack direction, thereby changing the internal volume of the liquid chamber and causing liquid (liquid droplets) to be discharged from the nozzle 98*a*. Accordingly, the piezoelectric element 86 is a driving element that drives the nozzle 98*a*.

Configuration of Control Unit According to First Embodiment

Figure 4:
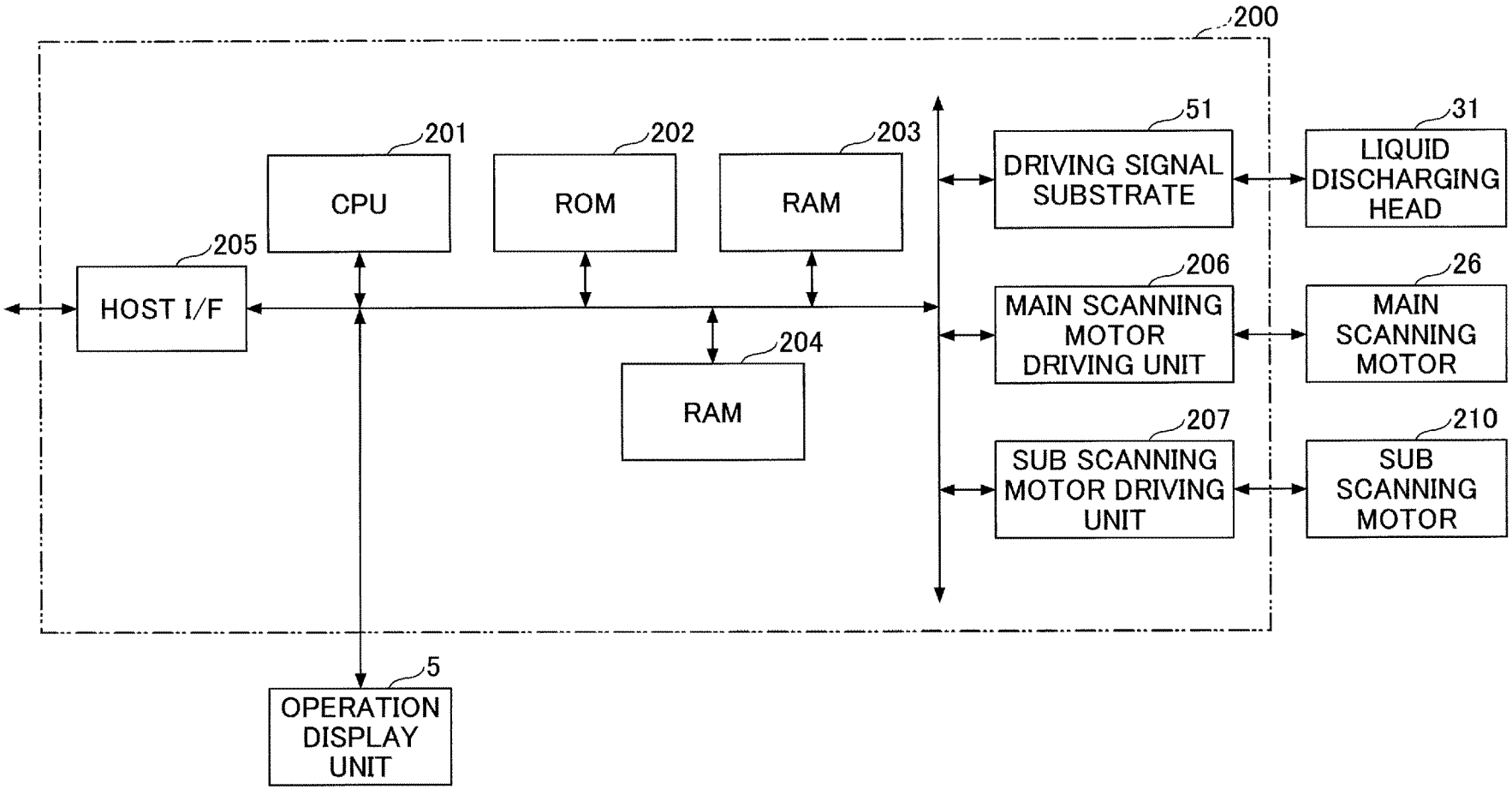
FIG. 4 is a block diagram illustrating a configuration of a control unit according to the first embodiment of the present invention.

Next, the configuration of the control unit of the liquid discharging apparatus 1 will be described. FIG. 4 is a block diagram illustrating the configuration of a control unit 200 of the liquid discharging apparatus 1.

The control unit 200 includes a Central Processing Unit (CPU) 201, a Read-Only Memory (ROM) 202, a Random Access Memory (RAM) 203, a RAM 204, and a host interface (I/F) 205.

The CPU 201 controls the overall liquid discharging apparatus 1. The ROM 202 stores programs executed by the CPU 201 and various kinds of data. The RAM 203 temporarily stores image data and the like. The RAM 204 stores data that needs to be held when the power is turned off.

The host I/F 205 receives image data transmitted from a host device such as a personal computer, etc., in a wired or wireless manner.

The control unit 200 further includes the aforementioned driving signal substrate 51, a main scanning motor driving unit 206 for driving the main scanning motor 26, and a sub scanning motor driving unit 207 for driving the sub scanning motor 210. The CPU 201 performs image recording operations on the paper sheet 11 by controlling the driving signal substrate 51, the main scanning motor driving unit 206, and the sub scanning motor driving unit 207.

Figure 5:
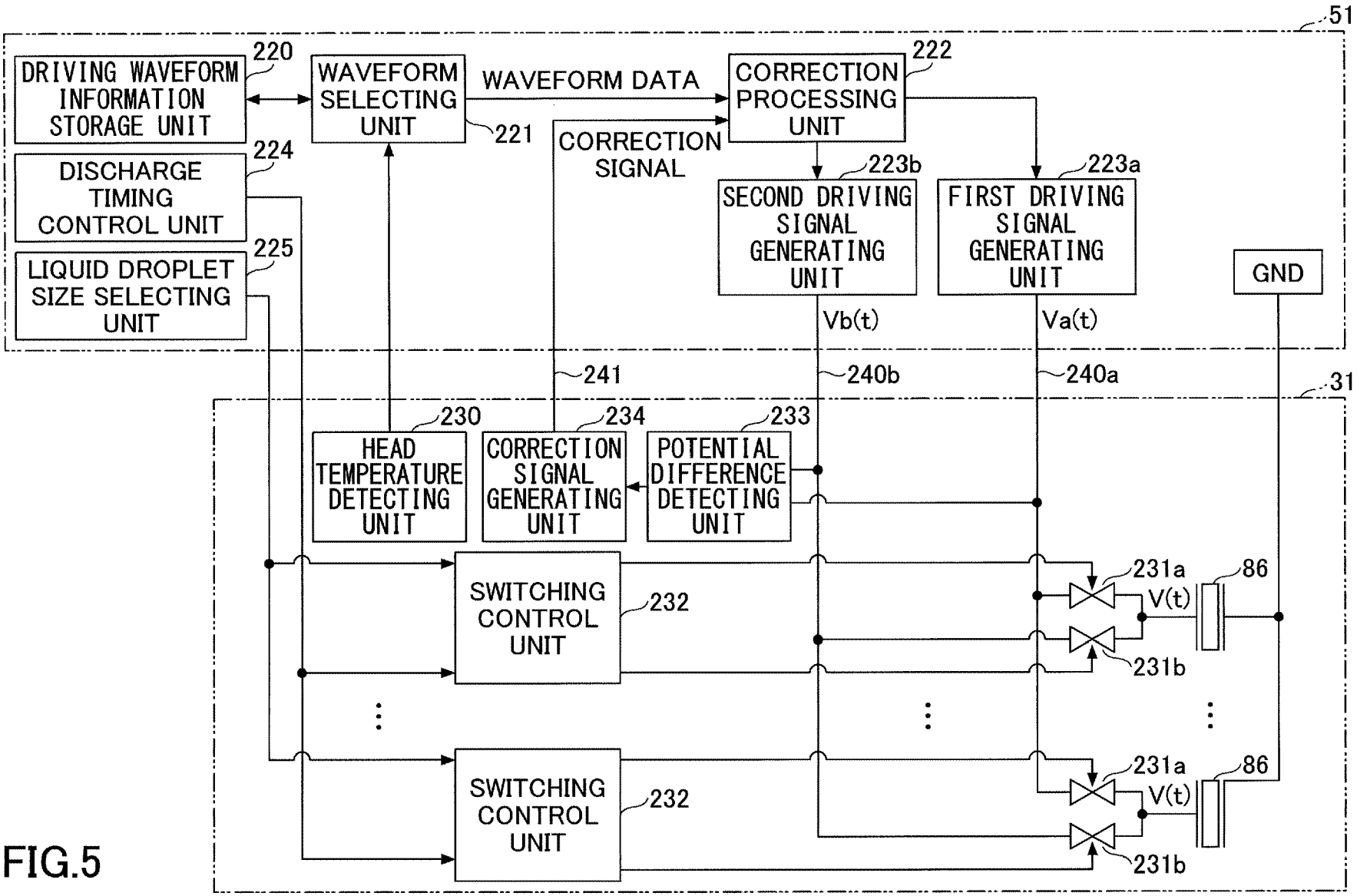
FIG. 5 is a block diagram illustrating the electrical configuration of a driving signal substrate and the liquid discharging head according to the first embodiment of the present invention.

Electrical Configuration of Driving Signal Substrate and Liquid Discharging Head According to First Embodiment FIG. 5 is a block diagram illustrating the electrical configuration of the driving signal substrate 51 and the liquid discharging head 31. The liquid discharging apparatus 1 is configured to discharge liquid (liquid droplets) by inputting a driving signal generated in the driving signal substrate 51 into each of the piezoelectric elements 86 in the liquid discharging head 31.

The driving signal substrate 51 includes a driving waveform information storage unit 220, a waveform selecting unit 221, a correction processing unit 222, a first driving signal generating unit 223*a*, a second driving signal generating unit 223*b*, a discharge timing control unit 224, and a liquid droplet size selecting unit 225.

The liquid discharging head 31 includes a head temperature detecting unit 230, a first switching element 231*a* (hereinafter, the first SW 231*a*), a second switching element 231*b* (hereinafter, the second SW 231*b*), a switching control unit 232, a potential difference detecting unit 233, and a correction signal generating unit 234.

The driving waveform information storage unit 220 stores waveform data according to the size of the liquid droplets, the temperature of the liquid droplets, or the like. The waveform selecting unit 221 selects the waveform data from the driving waveform information storage unit 220 based on a temperature detection signal of the head temperature detected by the head temperature detecting unit 230 in the liquid discharging head 31, and outputs the waveform data to the correction processing unit 222.

The correction processing unit 222 holds correction signals (a first offset signal and a second offset signal) supplied from the correction signal generating unit 234, which will be described later, and corrects the waveform data based on the correction signals. The corrected waveform data is input to the first driving signal generating unit 223*a* and the second driving signal generating unit 223*b*.

Different kinds of waveform data are input to the first driving signal generating unit 223*a* and the second driving signal generating unit 223*b*. For example, waveform data items corresponding to different liquid droplet sizes are input to the first driving signal generating unit 223*a* and the second driving signal generating unit 223*b*, respectively. For example, waveform data for generating a liquid droplet having a small liquid droplet size is input to the first driving signal generating unit 223*a*, and waveform data for generating a liquid droplet having a large liquid droplet size is input to the second driving signal generating unit 223*b*.

The first driving signal generating unit 223*a* generates a first driving signal Va(t) for generating small liquid droplets and outputs the first driving signal Va(t) to a signal line 240*a* to transmit the first driving signal Va(t) to the liquid discharging head 31. The second driving signal generating unit 223*b* generates a second driving signal Vb(t) for generating large liquid droplets and outputs the second driving signal Vb(t) to a signal line 240*b* to transmit the second driving signal Vb(t) to the liquid discharging head 31. The signal line 240*a* and the signal line 240*b* correspond to a first signal transmitter for transmitting driving signals, formed via the FFC 12 and the relay substrate 56.

Figure 6:
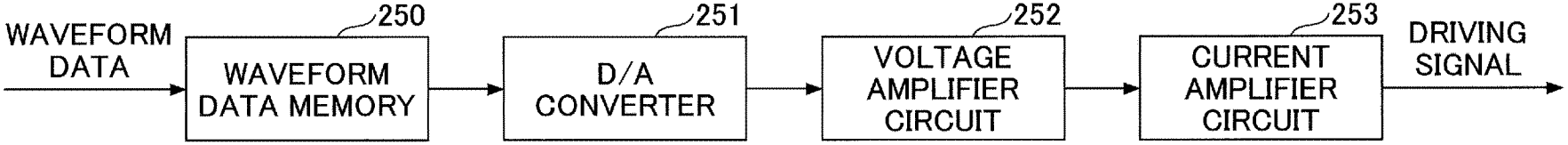
FIG. 6 is a block diagram illustrating the configuration of a first driving signal generating unit and a second driving signal generating unit according to the first embodiment of the present invention.

FIG. 6 is a block diagram illustrating a configuration of the first driving signal generating unit 223*a* and the second driving signal generating unit 223*b*. The first driving signal generating unit 223*a* and the second driving signal generating unit 223*b* each include a waveform data memory 250, a D/A converter 251, a voltage amplifier circuit 252, and a current amplifier circuit 253.

The waveform data memory 250 stores the waveform data input from the correction processing unit 222. In the waveform data memory 250, when new waveform data is input from the correction processing unit 222, the stored waveform data is erased and the waveform data is updated to new waveform data.

The D/A converter 251 converts the waveform data output from the waveform data memory 250 into an analog signal. The voltage amplifier circuit 252 amplifies the voltage of the analog signal obtained by the conversion by the D/A converter 251. The current amplifier circuit 253 amplifies the current of the signal whose voltage has been amplified by the voltage amplifier circuit 252. The signal output from the current amplifier circuit 253 becomes a driving signal.

The first driving signal generating unit 223*a* and the second driving signal generating unit 223*b* operate in synchronization with a predetermined clock signal in a predetermined discharge cycle T. The first driving signal Va(t) and the second driving signal Vb(t) change cyclically depending on a time t.

Returning to FIG. 5, the first SW 231*a* and the second SW 231*b* are connected in parallel to one electrode of each of the piezoelectric elements 86. The other electrode of each of the piezoelectric elements 86 is connected to ground (GND).

The terminal of the first SW 231*a* on the side opposite to the piezoelectric element 86, is connected to the signal line 240*a* through which the first driving signal Va(t) is transmitted. The terminal of the second SW 231*b* on the side opposite to the piezoelectric element 86 is connected to the signal line 240*b* through which the second driving signal Vb(t) is transmitted. That is, the first SW 231*a* switches the connection between the piezoelectric element 86 and the signal line 240*a* between on and off. The second SW 231*b* switches the connection between the piezoelectric element 86 and the signal line 240*b* between on and off.

The switching of the first SW 231*a* and the second SW 231*b* is controlled by the switching control unit 232.

The switching control unit 232 alternatively turns on the first SW 231*a* and the second SW 231*b* based on a timing control signal from the discharge timing control unit 224 and a liquid droplet size selection signal from the liquid droplet size selecting unit 225. That is, either one of the first driving signal Va(t) or the second driving signal Vb(t) is selected and is input as a driving signal V(t) into the piezoelectric element 86.

The discharge timing control unit 224 generates a discharge timing control signal, based on an instruction from the CPU 201 that is based on image data, and outputs the signal to each of the switching control units 232. The liquid droplet size selecting unit 225 generates a liquid droplet size selection signal, based on an instruction from the CPU 201 that is based on image data, and outputs the signal to each of the switching control units 232. Each of the switching control units 232 controls which one of the first SW 231*a* and the second SW 231*b* is to be turned on and the timing when the selected SW is to be turned on, based on the discharge timing control signal and the liquid droplet size selection signal.

The potential difference detecting unit 233 is connected to the signal line 240*a* and the signal line 240*b*. The potential difference detecting unit 233 calculates a first potential difference, which is the potential difference between an intermediate potential of the first driving signal Va(t) transmitted through the signal line 240*a* and an ideal potential Vi, and calculates a second potential difference, which is the potential difference between an intermediate potential of the second driving signal Vb(t) transmitted through the signal line 240*b* and the ideal potential Vi. Here, an intermediate potential is the reference potential of the first driving signal Va(t) and the second driving signal Vb(t), and is the potential at an initial time (t=0) and an end time (t=T) of each discharge cycle T. The ideal potential is the ideal intermediate potential Vi at which the potential is not displaced.

The potential difference detecting unit 233 holds the value of the ideal potential Vi and detects a first potential difference ΔVa and a second potential difference ΔVb represented by the following formulas (1) and (2).

$$\Delta Va = Va(0) - Vi \quad (1)$$

$$\Delta Vb = Vb(0) - Vi \quad (2)$$

The correction signal generating unit 234 generates and outputs a first offset signal representing a first potential difference ΔVa and a second offset signal representing a second potential difference ΔVb. The correction signal generating unit 234 transmits the first offset signal and the second offset signal as correction signals to the driving signal substrate 51 via a signal line 241. The signal line 241 is a second signal transmitter for transmitting correction signals, and the signal line 241 is formed via the FFC 12 and the relay substrate 56.

The correction processing unit 222 in the driving signal substrate 51 performs offset correction on the waveform data for generating small liquid droplets input from the waveform selecting unit 221, based on the first offset signal; and performs offset correction on the waveform data for generating large liquid droplets input from the waveform selecting unit 221, based on the second offset signal. Accordingly, the waveform data for generating small liquid droplets that has undergone offset correction is input to the first driving signal generating unit 223*a*. The waveform data for generating large liquid droplets that has undergone offset correction is input to the second driving signal generating unit 223*b*.

As a result, the first driving signal Va(t) and the second driving signal Vb(t) respectively generated by the first driving signal generating unit 223*a* and the second driving signal generating unit 223*b* are corrected as indicated in the following formulas (3) and (4), respectively.

$$Va'(t) = Va(t) - \Delta Va \quad (3)$$

$$Vb'(t) = Vb(t) - \Delta Vb \quad (4)$$

Here, Va'(t) and Vb'(t) represent the first driving signal and the second driving signal after correction, respectively.

Offset Correction of Driving Signal According to First Embodiment

Next, offset correction of the first driving signal Va(t) and the second driving signal Vb(t) will be described.

Figure 7:
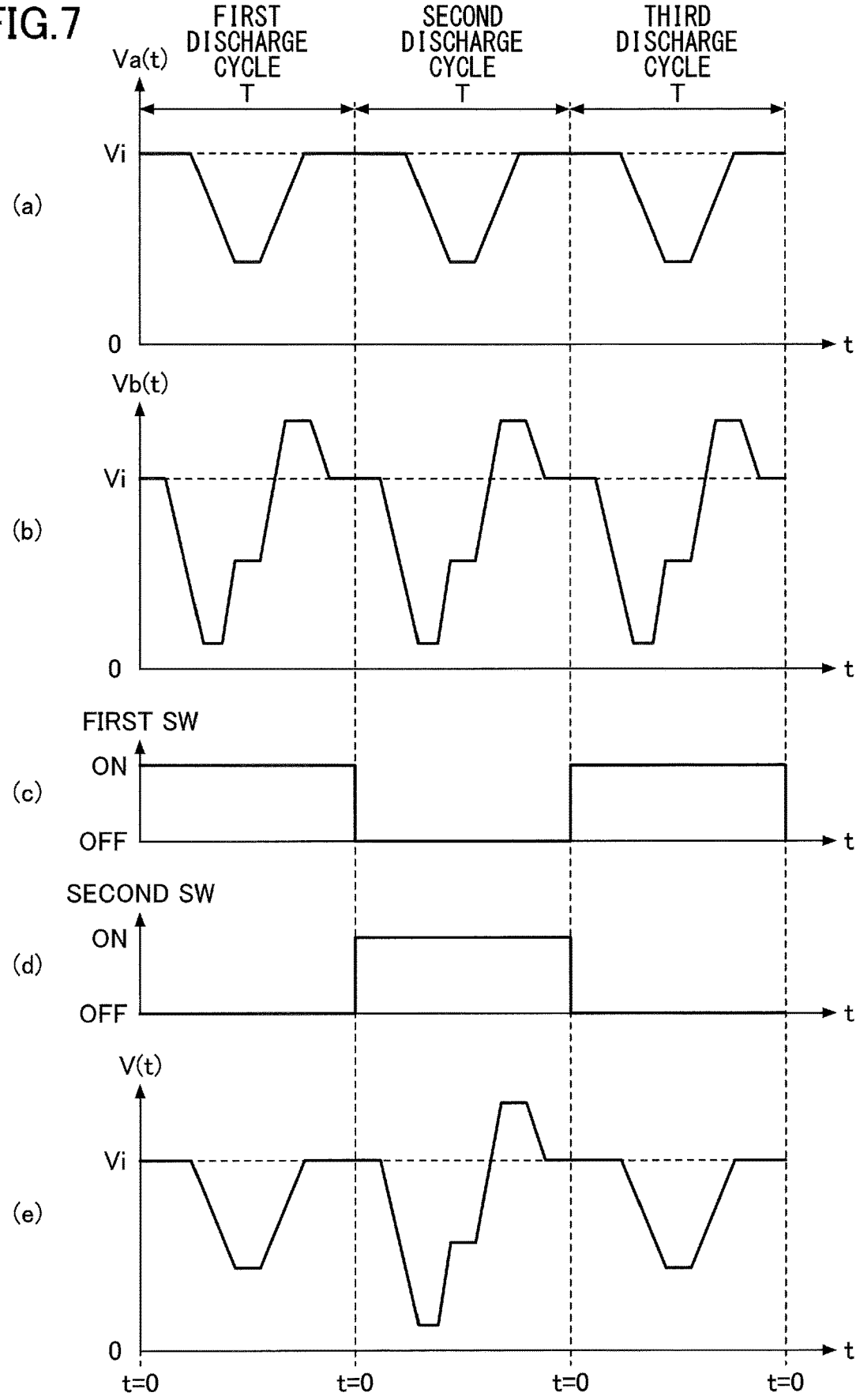
FIG. 7 is a diagram illustrating waveforms of driving signals, etc., in an ideal state.

FIG. 7 is a diagram illustrating waveforms of driving signals, etc., in an ideal state. In (a) in FIG. 7, the waveform of the first driving signal Va(t) is illustrated. In (b) in FIG. 7, the waveform of the second driving signal Vb(t) is illustrated. In (c) in FIG. 7, a first switching signal provided to the first SW 231*a* is illustrated. In (d) in FIG. 7, a second switching signal provided to the second SW 231*b* is illustrated. In (e) in FIG. 7, a driving signal V(t) input to the piezoelectric element 86 is illustrated.

By the first and second switching signals, the first driving signal Va(t) is selected in the first discharge cycle, the second driving signal Vb(t) is selected in the second discharge cycle, and the first driving signal Va(t) is selected in the third discharge cycle.

FIG. 7 illustrates a case in which the intermediate potential Va(0) of the first driving signal Va(t) and the intermediate potential Vb(0) of the second driving signal Vb(t) are both matching the ideal potential Vi. In this case, when the driving signal is switched between discharge cycles, there will be no potential difference.

Figure 8:
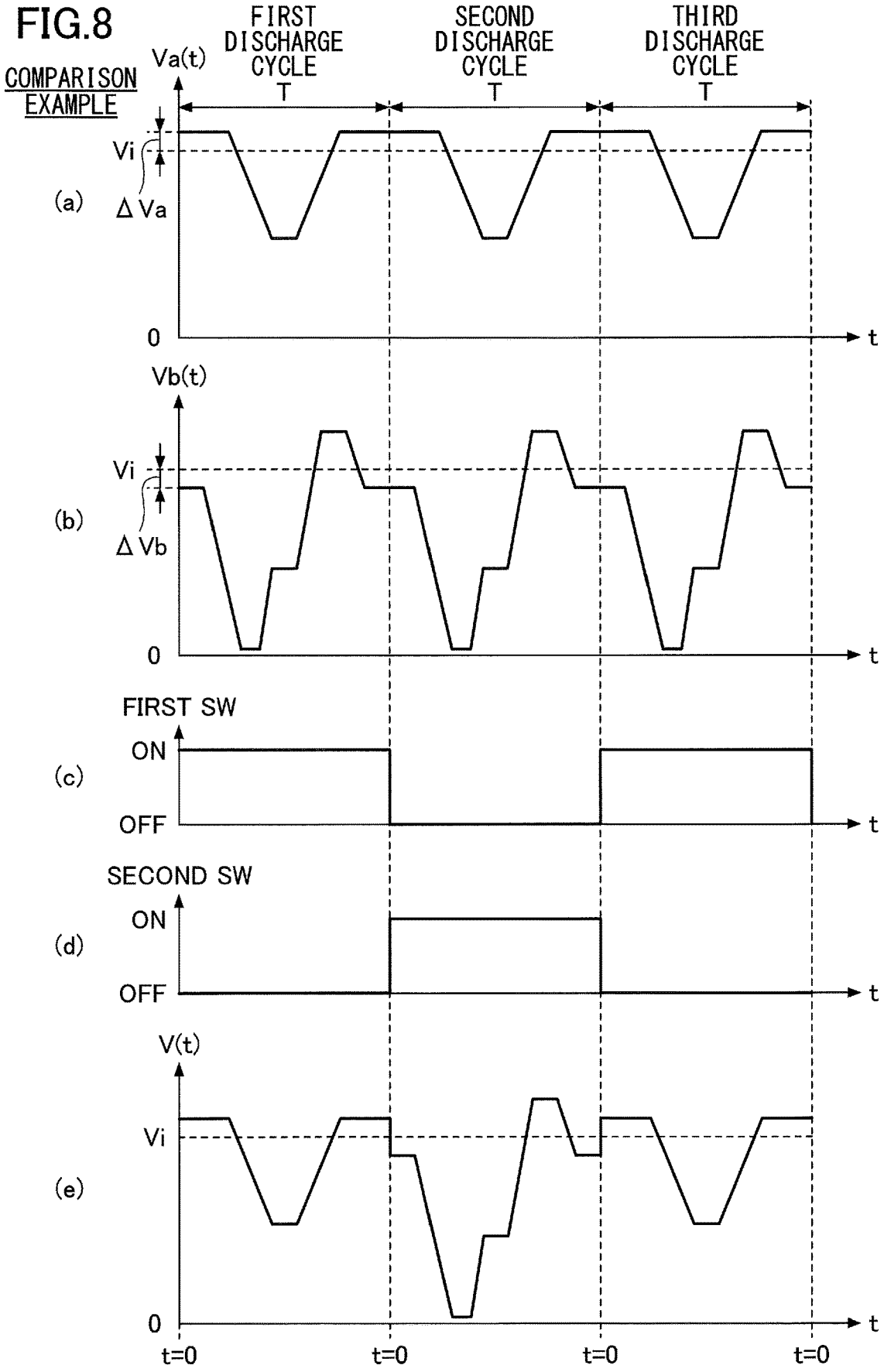
FIG. 8 is a diagram illustrating waveforms of driving signals, etc., in which the intermediate potential is displaced but offset correction is not performed, according to a comparison example.

FIG. 8 is a diagram illustrating waveforms of driving signals, etc., of a comparison example, in which the intermediate potential is displaced but offset correction is not performed. In (a) to (e) in FIG. 8, waveforms of signals similar to those of (a) to (e) in FIG. 7 are illustrated, respectively.

In (a) in FIG. 8, a case in which the potential difference ΔVa of the intermediate potential Va(0) of the first driving signal Va(t) with respect to the ideal potential Vi is not zero, is illustrated. In (b) in FIG. 8, a case in which the potential difference ΔVb of the intermediate potential Vb(0) of the second driving signal Vb(t) with respect to the ideal potential Vi is not zero, is illustrated. These potential differences may be caused by different signal amplification rates or different attenuation rates during transmission, depending on manufacturing variations in the first driving signal generating unit 223*a* and the second driving signal generating unit 223*b* and manufacturing variations in the first signal transmitter.

In this case, as illustrated in (e) in FIG. 8, when the driving signal is switched between discharge cycles, a steep change occurs in electric potential, and an unexpected current flows to the piezoelectric element 86, thereby causing failures or malfunctions of the piezoelectric element 86.

For example, as between the first discharge cycle and the second discharge cycle in FIG. 8, when the potential changes from a high potential Va(T) to a low potential Vb(0), the piezoelectric element 86 contracts and pressure is generated in a direction in which the meniscus surface of the liquid discharging head 31 is drawn into the interior of the nozzle 98*a*. By this drawing-in operation per se, abnormal liquid discharging may not occur; however, interference may occur in the subsequent meniscus operation performed by the second driving signal Vb(t), and consequently, the liquid discharging may not be performed in a normal manner.

Conversely, as between the second discharge cycle and the third discharge cycle in FIG. 8, when the potential changes from the low potential Vb(T) to the high potential Va(0), pressure is generated in a direction in which the meniscus surface of the liquid discharging head 31 is pushed out to the outside of the nozzle 98*a*. This is a movement in the direction in which discharging is performed, which may lead to abnormal liquid discharging. Even if abnormal liquid discharging does not occur, interference may occur in the subsequent meniscus operation by the first driving signal Va(t), and consequently, the liquid discharging may not be performed in a normal manner.

Moreover, if a steep change in the potential is repeated many times at high speed, the first SW 231*a* and the second SW 231*b* may be damaged, and the image quality may be significantly impaired.

Figure 9:
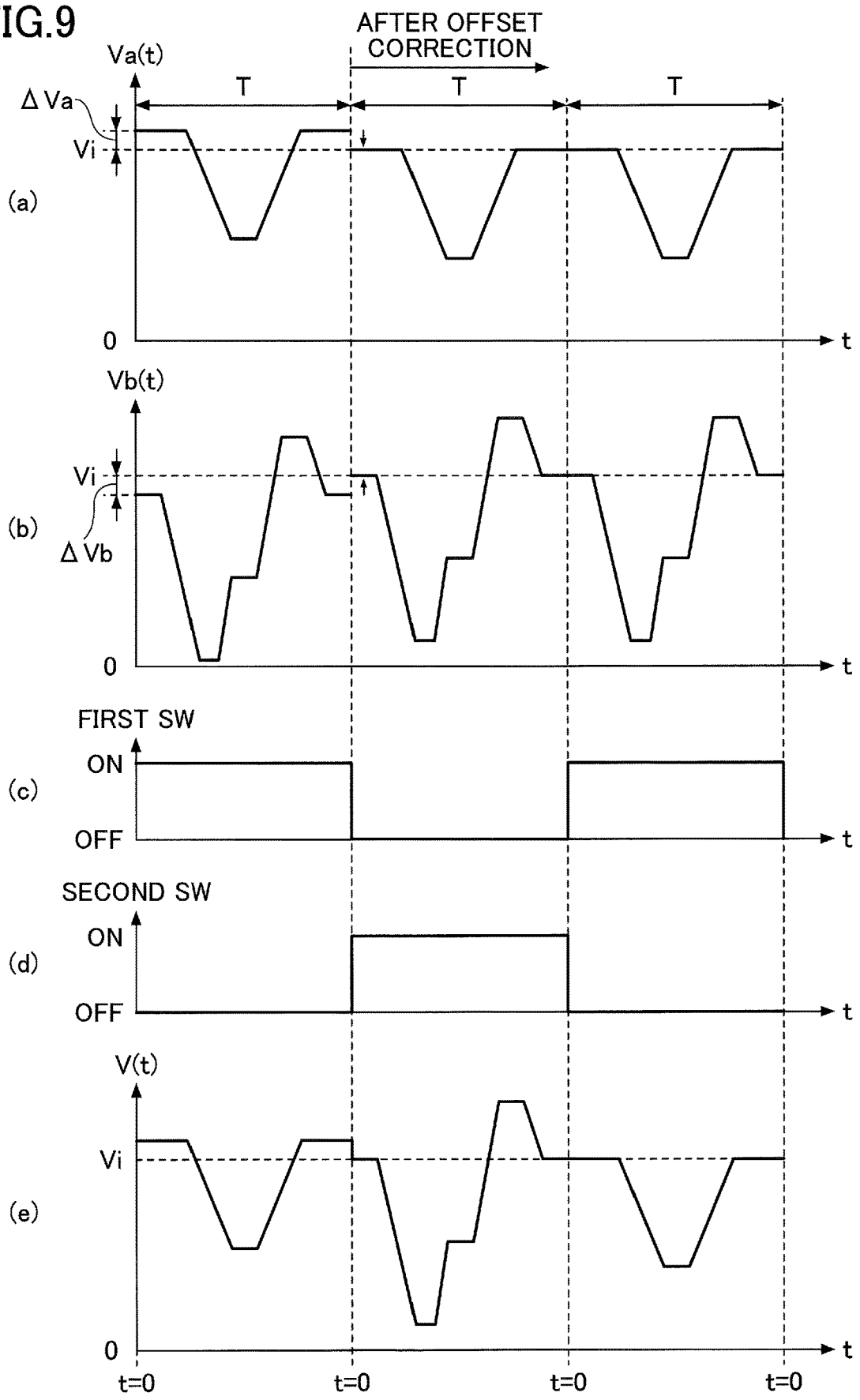
FIG. 9 is a diagram illustrating waveforms of driving signals, etc., in which the intermediate potential is displaced and offset correction is performed according to the first embodiment of the present invention.

FIG. 9 is a diagram illustrating waveforms of driving signals, etc., in which the intermediate potential is displaced and offset correction is performed. In (a) to (e) in FIG. 9, waveforms of signals similar to those of (a) to (e) in FIG. 7 are illustrated, respectively.

As illustrated in (a) and (b) in FIG. 9, when the potential difference ΔVa and the potential difference ΔVb are not zero, these potential differences are detected by the potential difference detecting unit 233, and the first offset signal and the second offset signal as correction signals are generated by the correction signal generating unit 234 and are input to the correction processing unit 222. The correction processing unit 222 corrects the waveform data based on the input correction signals and inputs the waveform data to the first driving signal generating unit 223*a* and the second driving signal generating unit 223*b*. These processes are performed within the first discharge cycle.

After the first discharge cycle, the first driving signal generating unit 223*a* and the second driving signal generating unit 223*b* respectively output the first driving signal Va'(t) and the second driving signal Vb'(t) after correction that have undergone the offset correction.

As a result, as illustrated in (e) in FIG. 9, in the second discharge cycle and onwards, the intermediate potential Va(0) and the intermediate potential Vb(0) approximately match the ideal potential Vi, thereby preventing changes in the potential at the time when the driving signal is switched (between discharge cycles). This prevents failures or malfunctions of the piezoelectric element 86.

Operation Flow According to First Embodiment

Figure 10:
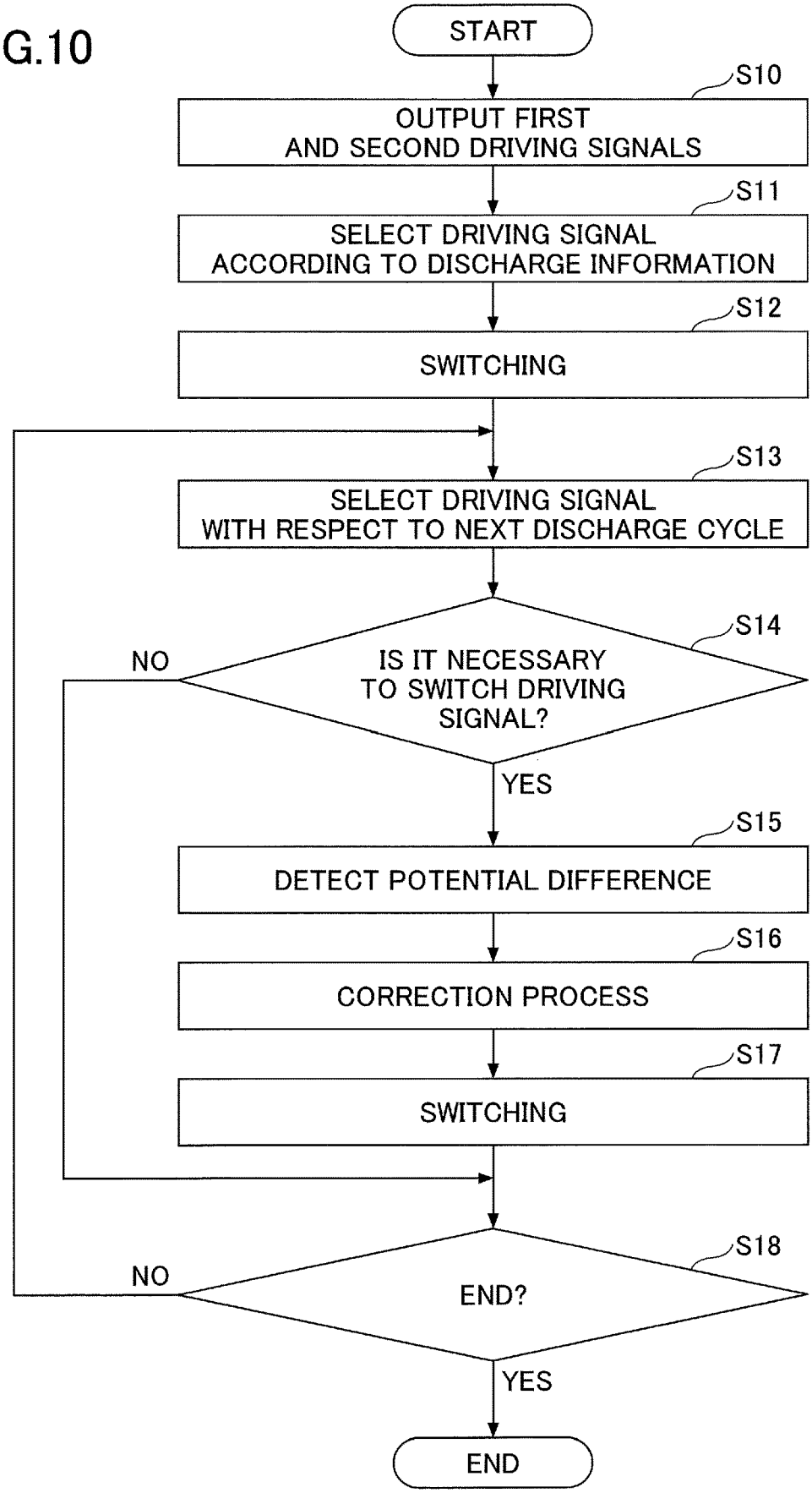
FIG. 10 is a flowchart illustrating an operation by the liquid discharging apparatus according to the first embodiment of the present invention.

Next, an operation flow of the liquid discharging apparatus 1 will be described. FIG. 10 is a flowchart illustrating an operation of the liquid discharging apparatus 1.

Each operation of the liquid discharging apparatus 1 illustrated in FIG. 10 is performed based on control by the CPU 201. In step S10, when starting the image recording operation on the paper sheet 11, first, the CPU 201 causes the first driving signal generating unit 223*a* and the second driving signal generating unit 223*b* to start outputting the first driving signal Va(t) and the second driving signal Vb(t).

Next, the CPU 201 selects a driving signal in accordance with the discharge information based on the discharge information (step S11), and causes the switching control unit 232 to execute switching control via the discharge timing control unit 224 and the liquid droplet size selecting unit 225 (step S12). For example, when it is necessary to discharge small liquid droplets, the first driving signal Va(t) is selected (step S11), and the first SW 231*a* is turned on. Accordingly, the driving signal V(t) is input to the piezoelectric element 86, and the discharge operation in the first discharge cycle is started.

Next, in step S13, the CPU 201 selects the driving signal for the next discharge cycle based on the discharge information. Then, in step S14, the CPU 201 determines whether it is necessary to switch the driving signal for the next discharge cycle. For example, when the first driving signal Va(t) is selected for the first discharge cycle and the second driving signal Vb(t) is to be selected for the second discharge cycle, it is determined that switching of the driving signal is necessary.

When it is necessary to switch the driving signal (YES in step S14), the CPU 201 causes the potential difference detecting unit 233 to perform the above-described potential difference detection operation (step S15), and causes the correction signal generating unit 234 to generate the correction signal and causes the correction processing unit 222 to perform offset correction processing (step S16). Accordingly, the first driving signal generating unit 223*a* and the second driving signal generating unit 223*b* output the first driving signal Va'(t) and the second driving signal Vb'(t) after correction. In step S17, the CPU 201 causes the switching control unit 232 to execute switching control.

Next, the CPU 201 determines whether to end the image recording operation (step S18), and ends the processing when the operation is to be ended (YES in step S18). Meanwhile, when the image recording operation is not to be ended (NO in step S18), the CPU 201 returns the processing to step S13. When the CPU 201 determines that the switching of the driving signal is not necessary in step S14 (NO in step S14), the CPU 201 advances the processing to step S18.

As described above, by performing potential difference detection and offset correction for each discharge cycle, the potential is always prevented from changing at the time of switching the driving signal.

The CPU 201 may execute the potential difference detection and the offset correction at the time when the liquid discharging apparatus 1 is powered on or the like. When the correction processing unit 222 is holding a correction signal, the correction signal is updated to a new correction signal.

Effect According to First Embodiment

According to the liquid discharging apparatus 1 according to the present embodiment, as described above, the potential difference detection and the offset correction are performed, and, therefore, the potential is prevented from changing when switching the driving signal. Further, by performing potential difference detection and offset correction for each discharge cycle, it is possible to attend to the change in potential depending on the change in temperature during the discharge operation.

In the present embodiment, the first SW 231*a* and the second SW 231*b* and the potential difference detecting unit 233 are disposed in the liquid discharging head 31 including the piezoelectric element 86, and, therefore, the potential difference detecting unit 233 is less affected by characteristics of the first signal transmitter, so that the potential difference detecting unit 233 can detect the potential difference with high accuracy, and the accuracy of the offset correction is improved.

Further, according to the present embodiment, the correction signal generating unit 234 is disposed inside the liquid discharging head 31, and, therefore, deterioration of the potential difference information can be prevented, so that a high-precision correction signal can be generated.

Second Embodiment

Hereinafter, a liquid discharging apparatus according to a second embodiment of the present invention will be described.

Figure 11:
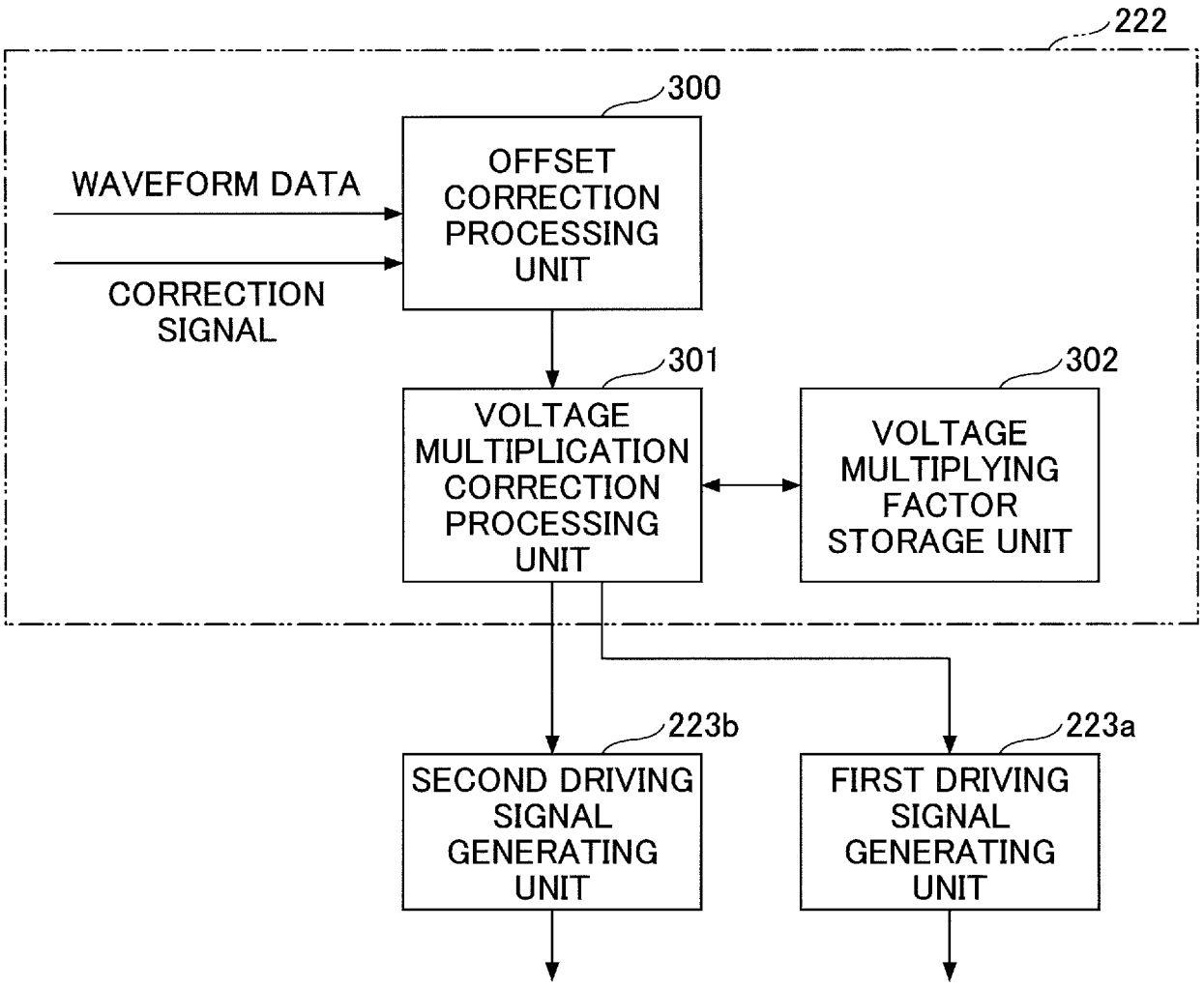
FIG. 11 is a diagram illustrating a configuration of a correction processing unit according to a second embodiment of the present invention.

FIG. 11 is a diagram illustrating a configuration of the correction processing unit 222 according to the second embodiment. In the present embodiment, the correction processing unit 222 includes an offset correction processing unit 300, a voltage multiplication correction processing unit 301, and a voltage multiplying factor storage unit 302.

The offset correction processing unit 300 performs the offset processing based on the correction signals (the first offset signal and the second offset signal) described in the first embodiment. The voltage multiplication correction processing unit 301 performs voltage multiplication correction processing with respect to the waveform data that has undergone offset processing, to adjust the speed and weight of the liquid (liquid droplets) discharged from the nozzle 98*a*. The voltage multiplying factor storage unit 302 stores the voltage multiplying factor used for the voltage multiplication correction process. The voltage multiplying factor is stored in the voltage multiplying factor storage unit 302 in advance, from an external personal computer (PC) or the like.

Voltage multiplication correction is a correction process of performing the calculation of multiplying a voltage signal forming the waveform data by a voltage multiplying factor, and is intended to increase or decrease the voltage multiplication by using the intermediate potential as a reference. By simply performing the voltage multiplication correction, the voltage value will be corrected by using the GND potential as the reference, and, therefore, if the intermediate potential is displaced, the amount of this displacement will affect the correction result, and further potential displacements may occur in the waveform data after the voltage multiplication correction.

Therefore, according to the present embodiment, the correction processing unit 222 is configured such that the voltage multiplication correction processing by the voltage multiplication correction processing unit 301 is performed after the offset correction processing by the offset correction processing unit 300.

Specifically, assuming that the waveform after offset correction is represented by the above-described formulas (3) and (4), the voltage multiplication correction processing unit 301 performs the correction processing based on the following formulas (5) and (6).

$$Va''(t)=(Va'(t)-Vi)\times X+Vi \tag{5}$$

$$Vb''(t)=(Vb'(t)-Vi)\times X+Vi \tag{6}$$

Here, X is the voltage multiplying factor stored in the voltage multiplying factor storage unit 302. Va"(t) and Vb"(t) represent the first driving signal and the second driving signal, respectively, after voltage multiplication correction.

That is, the voltage multiplication correction processing unit 301 multiplies the waveform, which is obtained by subtracting the ideal potential Vi from the waveform after the offset correction (the waveform in which the intermediate potential is GND potential), by the voltage multiplying factor, and adds the ideal potential Vi.

The waveform data that has undergone the voltage multiplication correction by the voltage multiplication correction processing unit 301, is input to the first driving signal generating unit 223*a* and the second driving signal generating unit 223*b*, and the first driving signal Va"(t) and the second driving signal Vb"(t) are generated.

The voltage multiplication correction process is performed in step S16 in the flowchart of the first embodiment illustrated in FIG. 10 after the offset correction process.

The other configurations and operations of the liquid discharging apparatus according to the second embodiment are the same as the configurations and operations of the liquid discharging apparatus according to the first embodiment.

Figure 12:
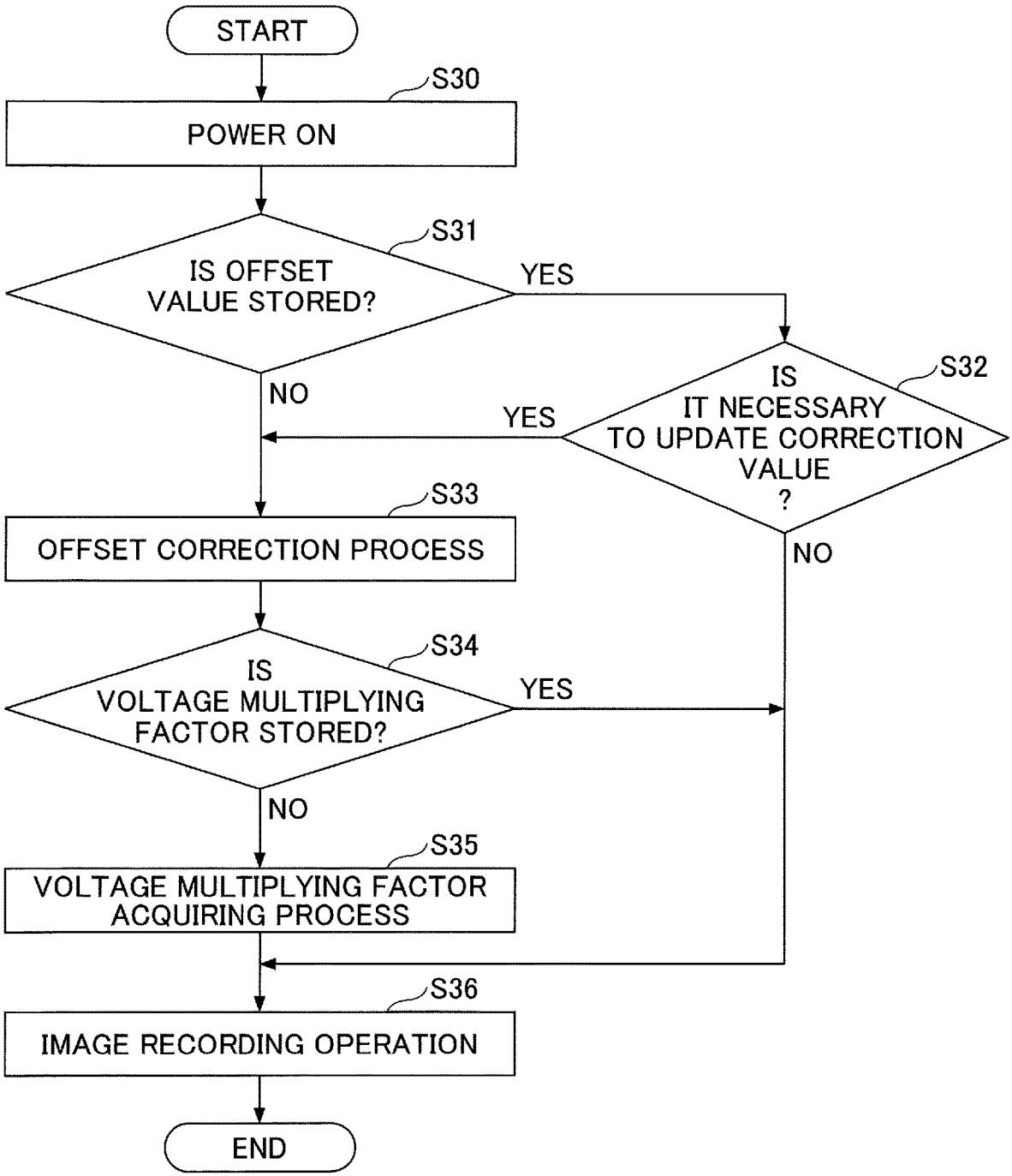
FIG. 12 is a flowchart illustrating an initial operation after the power is turned on according to the second embodiment of the present invention.

Note that in the second embodiment, it is preferable that the liquid discharging apparatus performs the initial operation illustrated in FIG. 12 after the power is turned on.

FIG. 12 is a flowchart illustrating the initial operation after the power is turned on. When the power button of the operation display unit 5 is operated and the power is turned on (step S30), the CPU 201 determines whether the offset values (the first offset signal and the second offset signal) are stored in the offset correction processing unit 300 (step S31).

When the offset value is stored in the offset correction processing unit 300 (YES in step S31), the CPU 201 determines whether it is necessary to update the correction value (step S32). For example, the CPU 201 displays a message on the operation display unit 5 and causes the user to select whether an update is necessary or not.

When the offset value is not stored in the offset correction processing unit 300 (NO in step S31), and when it is necessary to update the correction value (YES in step S32), the CPU 201 operates each unit to perform the above-described offset processing (step S33). Therefore, the offset value (correction signal) is acquired and stored in the offset correction processing unit 300.

Next, in step S34, the CPU 201 determines whether the voltage multiplying factor is stored in the voltage multiplying factor storage unit 302. When the voltage multiplying factor is not stored in the voltage multiplying factor storage unit 302 (NO in step S34), the CPU 201 executes a process of acquiring the voltage multiplying factor and stores the acquired voltage multiplying factor in the voltage multiplying factor storage unit 302 (step S35).

Thereafter, in step S36, the CPU 201 controls each unit to start an image recording operation on the paper sheet 11. When it is determined in step S32 that it is not necessary to update the correction value (NO in step S32), the CPU 201 skips steps S33 to S35 and starts the image recording operation.

As described above, in the second embodiment, the voltage multiplication correction is performed with the intermediate potential set to zero after the offset correction, and, therefore, the potential is prevented from being displaced by the voltage multiplication correction.

Third Embodiment

Hereinafter, a liquid discharging apparatus according to a third embodiment of the present invention will be described.

Figure 13:
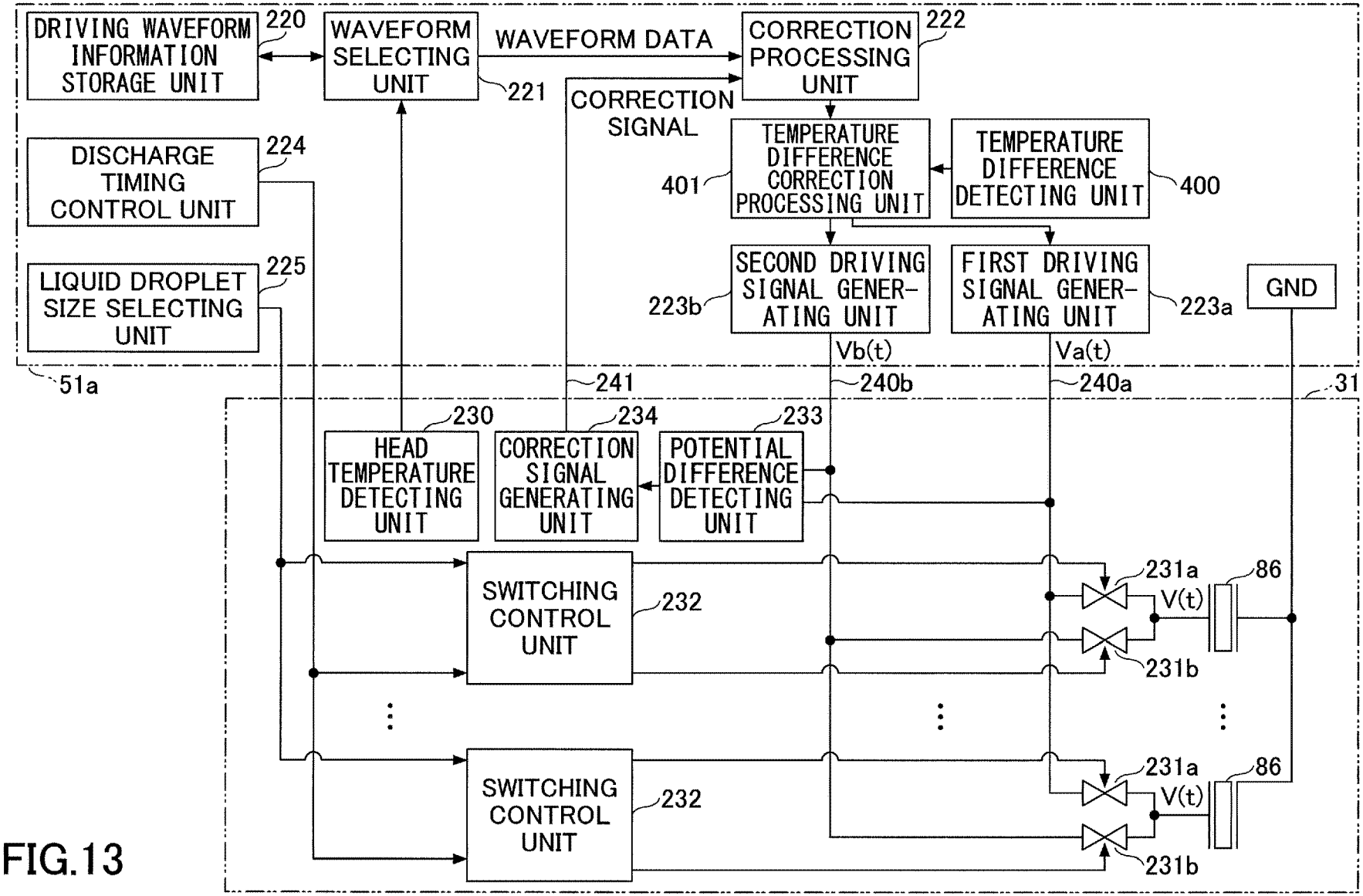
FIG. 13 is a block diagram illustrating an electrical configuration of a driving signal substrate and a liquid discharging head according to a third embodiment of the present invention.

FIG. 13 is a block diagram illustrating the electrical configuration of a driving signal substrate 51*a* and the liquid discharging head 31 according to the third embodiment. The driving signal substrate 51*a* according to the present embodiment further includes a temperature difference detecting unit 400 and a temperature difference correction processing unit 401.

The temperature difference detecting unit 400 is a temperature sensor that detects the temperature difference between the first driving signal generating unit 223*a* and the second driving signal generating unit 223*b*. The first driving signal generating unit 223*a* and the second driving signal generating unit 223*b* are respectively formed of individual circuits, and, therefore, a temperature difference may occur between these two units due to a difference in the heat generation amount or the like.

The temperature difference correction processing unit 401 corrects the waveform based on the temperature difference detected by the temperature difference detecting unit 400 so that there is no difference between the first driving signal and the second driving signal caused by the temperature difference.

The temperature difference detection process and the temperature difference correction process are performed in step S16 in the flowchart illustrated in FIG. 10.

The other configurations and operations of the liquid discharging apparatus according to the third embodiment are the same as the configurations and operations of the liquid discharging apparatus according to the first embodiment or the second embodiment.

As described above, in the third embodiment, the driving signal is corrected based on the temperature difference between the driving signal generating units, and, therefore, the correction can be performed with higher accuracy.

Modification Examples

In the above-described embodiments, two driving signal generating units are provided, that is, the first driving signal generating unit 223*a* and the second driving signal generating unit 223*b* are provided; however, the number of driving signal generating units is not limited to two, and may be three or more. In this case, a signal line for transmitting a driving signal to each of the driving signal generating units is provided in the first signal transmitter. The potential difference detecting unit 233 detects the potential difference between the intermediate potential of each driving signal and the ideal potential Vi. The correction signal generating unit 234 generates a correction signal (an offset signal) corresponding to each potential difference.

In each of the above-described embodiments, waveform data for generating small liquid droplets or waveform data for generating large liquid droplets is input to the driving signal generating unit; however, the waveform data is not limited thereto, and may be appropriately changed. For example, the waveform data for fine-driving may be input to the driving signal generating unit. Fine-driving is an operation for inputting a driving signal to the piezoelectric element 86 to agitate the nozzle surface without discharging liquid from the nozzle 98*a*, when the pixel corresponds to a white area in the image data.

The potential difference between the ideal potential and the intermediate potential used for correction, may be a value other than the value described above. For example, when the intermediate potential Va(0) of the first driving signal Va(t) and the intermediate potential Vb(0) of the second driving signal Vb(t) are different, the intermediate potential may be matched to either one of the intermediate potential Va(0) of the first driving signal Va(t) or the intermediate potential Vb(0) of the second driving signal Vb(t). A potential difference calculated based on such an intermediate potential may be used to generate a correction signal.

According to one embodiment of the present invention, the potential is prevented from changing when switching the driving signal.

The liquid discharging apparatus, the liquid discharging head, and the method for driving the liquid discharging head are not limited to the specific embodiments described in the detailed description, and variations and modifications may be made without departing from the spirit and scope of the present invention.

What is claimed is:

1. A liquid discharging apparatus comprising:

a liquid discharging head configured to discharge liquid from a nozzle;

a driving signal substrate configured to input, to the liquid discharging head, a driving signal according to waveform data;

a driving element configured to drive the nozzle;

a plurality of switching elements connected in parallel to the driving element;

a first signal transmitter connected to the driving element via the plurality of switching elements and formed of a plurality of signal lines through which the driving signal is transmitted;

a switching controller configured to perform switching control to selectively turn on one of the plurality of switching elements;

a potential difference detector configured to detect a potential difference based on an intermediate potential of the driving signal transmitted through each of the plurality of signal lines;

a correction signal generator configured to generate a correction signal based on the potential difference;

a correction processor configured to correct the waveform data based on the correction signal; and a driving signal generator provided to each of the plurality of signal lines and configured to generate the driving signal based on the waveform data corrected by the correction processor and to output the generated driving signal to a corresponding signal line among the plurality of signal lines.

2. The liquid discharging apparatus according to claim 1, wherein the correction processor includes an offset correction processor configured to perform offset correction to correct the waveform data so as to eliminate the potential difference, based on the correction signal.

3. The liquid discharging apparatus according to claim 2, wherein the correction processor further includes a voltage multiplication correction processor configured to perform voltage multiplication correction by multiplying waveform data, which is obtained by subtracting an ideal potential from the waveform data that has undergone the offset correction, by a voltage multiplying factor, and adding the ideal potential.

4. The liquid discharging apparatus according to claim 1, wherein the driving signal generator outputs the driving signal based on the waveform data that cyclically differs in a predetermined discharge cycle, and the driving signal to be input to the driving element is selected according to the switching control.

5. The liquid discharging apparatus according to claim 1, further comprising:

a second signal transmitter configured to transmit the correction signal to the correction processor from the correction signal generator.

6. The liquid discharging apparatus according to claim 1, wherein the detecting of the potential difference by the potential difference detector, the generating of the correction signal by the correction signal generator, and the correcting by the correction processor are executed for each discharge cycle.

7. The liquid discharging apparatus according to claim 1, wherein the detecting of the potential difference by the potential difference detector, the generating of the correction signal by the correction signal generator, and the correcting by the correction processor are executed before an operation of recording an image onto a recording medium performed by the liquid discharging head.

8. The liquid discharging apparatus according to claim 1, wherein the driving element is a piezoelectric element.

9. The liquid discharging apparatus according to claim 1, wherein the potential difference is a potential difference between the intermediate potential and an ideal potential.

10. A liquid discharging head comprising:

a driving element configured to drive a nozzle configured to discharge liquid;

a plurality of switching elements connected in parallel to the driving element;

a first signal transmitter connected to the driving element via the plurality of switching elements and formed of a plurality of signal lines through which a driving signal is transmitted according to waveform data; and a potential difference detector configured to detect a potential difference based on an intermediate potential of the driving signal transmitted through each of the plurality of signal lines.

11. A method for driving a liquid discharging head, the liquid discharging head including a driving element configured to drive a nozzle configured to discharge liquid, a plurality of switching elements connected in parallel to the driving element, a first signal transmitter connected to the driving element via the plurality of switching elements and formed of a plurality of signal lines through which a driving signal is transmitted according to waveform data, and a potential difference detector configured to detect a potential difference based on an intermediate potential of the driving signal transmitted through each of the plurality of signal lines, the method comprising:

generating a correction signal based on the potential difference detected by the potential difference detector;

correcting the waveform data based on the correction signal;

generating the driving signal based on the waveform data corrected by the correction signal; and outputting the generated driving signal to a corresponding signal line among the plurality of signal lines.

* * * * *